US006485570B2

(12) United States Patent
Iida et al.

(10) Patent No.: US 6,485,570 B2
(45) Date of Patent: Nov. 26, 2002

(54) SINK ROLL BLADE APPARATUS USED IN CONTINUOUS MOLTEN METAL PLATING APPARATUS AND METHOD FOR PREVENTING OCCURRENCE OF DENTS

(75) Inventors: Sachihiro Iida, Tokyo (JP); Yukihiko Uchiyama, Kurashiki (JP)

(73) Assignee: Kawasaki Steel Corporation, Hyogo (JP)

( * ) Notice: Subject to any disclaimer, the term of this patent is extended or adjusted under 35 U.S.C. 154(b) by 0 days.

(21) Appl. No.: 09/797,833

(22) Filed: Mar. 5, 2001

(65) Prior Publication Data

US 2001/0022156 A1 Sep. 20, 2001

(30) Foreign Application Priority Data

Mar. 16, 2000 (JP) ..... 2000-073661

(51) Int. Cl.[7] ..... B05C 11/02
(52) U.S. Cl. ..... 118/413; 118/414; 427/431
(58) Field of Search ..... 118/413, 414; 15/256.5, 256.51; 427/431

(56) References Cited

FOREIGN PATENT DOCUMENTS

| | | |
|---|---|---|
| DE | 44 41 243 A | 5/1996 |
| EP | 0 767 253 A1 | 4/1997 |
| JP | A-61-139658 | 6/1986 |
| JP | A-4-165056 | 6/1992 |

*Primary Examiner*—Laura Edwards
(74) *Attorney, Agent, or Firm*—Oliff & Berridge, PLC

(57) ABSTRACT

An apparatus installed in a molten metal plating line includes a blade pressed against a roll dipped in a molten metal plating bath, in which a metal strip travels. The apparatus removes substances deposited on a surface of the roll. The apparatus also includes an arm for supporting the blade, and a screw member disposed above the plating bath so as to traverse it and moving along an axis of the roll in the bath for removing substances deposited on the roll in the molten metal plating bath. Floats and/or weights are mounted on the arm so as to adjust a press force of the blade applied to the roll in the molten metal plating bath. A method for preventing the occurrence of dents on a molten-metal-plated steel strip using the apparatus is also disclosed.

32 Claims, 4 Drawing Sheets

SINK ROLL BLADE APPARATUS USED IN CONTINUOUS MOLTEN METAL PLATING APPARATUS AND METHOD FOR PREVENTING OCCURRENCE OF DENTS

BACKGROUND OF THE INVENTION

1. Field of Invention

This invention relates to apparatus for removing substances deposited on rolls in molten metal plating baths. This invention also relates to methods for preventing the occurrence of dents formed on molten metal plated metal strips.

2. Description of Related Art

In a continuous molten zinc plating line for galvanizing a traveling steel strip (also called steel sheet) by continuously dipping the strip in a molten zinc plating bath, molten zinc deposited on surfaces of the steel strip having been pulled up from the molten zinc plating bath is usually wiped by blowing gas (called wiping gas) against the surface of the steel strip through gas blowing nozzles called wiping nozzles in order to adjust the amount of the molten zinc deposited on surfaces of the steel strip. For this purpose, the steel strip is dipped in the molten zinc plating bath (hereinafter, referred to as a plating bath) obliquely downward and is pulled upward from the plating bath by changing the traveling direction of the steel strip to a vertical direction. The traveling direction of the steel strip is ordinarily changed by a rotary body (roll) called a sink roll dipped in the plating bath.

A large amount of foreign substances called dross are ordinarily produced in the plating bath by the precipitation and oxidation of Zn—Fe alloy, Zn—Al alloy and the like, and deposited on surfaces of the sink roll. Then, when the dross has grown to a certain size, it comes into contact with the steel strip traveling on the sink roll and causes defects of dents on surfaces of the steel strip.

In particular, while alloyed-molten-zinc-plated steel sheet has recently been used as steel sheet for automobiles in a large quantity, automobile manufacturers require more severe quality for steel sheet and even a minute defect on the plated steel sheet is not permitted. Accordingly, the defects of dents caused by the deposition of dross on the surface of the sink roll are a very serious problem to steel sheet suppliers.

Countermeasures for this problem have been studied. For example, a technology for thermal spraying ceramic, on which it is difficult to deposit dross, onto the surface of the sink roll has been proposed. However, the dross deposited on the surface of the sink roll cannot be perfectly prevented by this technology.

Thus, a method for mechanically removing foreign substances on the surface of the sink roll has been developed and is in practical use. Specifically, the method removes foreign substances by scraping them away by pressing a blade, which has a length entirely covering the surface of a sink roll in its axial direction, against the surface of the sink roll.

The blade must be in uniform contact with the entire surface of the sink roll in its axial direction in the conventional technology, which is very difficult to achieve, and the surface of the sink roll has not yet been put in a satisfactory contact state. In particular, the blade has such a defect that it is worn by use, which makes it more difficult for the blade to be in uniform contact with the surface of the sink roll. Further, when the blade is unevenly worn, the overall blade must be replaced to ensure uniform contact of the blade, from which the problem arises that the cost of the blade is increased.

To cope with the above problem, the applicant previously proposed a method for scraping away deposited substances by moving a narrow blade along the axis of a sink roll in Japanese Unexamined Patent Application Publication No. 61-133369. At that time, the applicant also proposed to control the press force of a drive unit (composed of a worm gear, a worm wheel, a screw shaft and the like) for moving the blade forward and backward with respect to the surface of the sink roll, so as to adjust the press force to a proper value by mounting a sensor (torque sensor) for measuring the press force on the blade in order to uniformly press the blade against the sink roll. The reason that the press force is measured is that the sink roll is not generally rotated by a motor and rotated by a steel strip that travels in contact with the sink roll. Thus, an excessively large press force stops the sink roll and operation cannot be smoothly carried out.

However, this technology requires a torque sensor and the blade drive unit, which makes the apparatus more complex and expensive than desired. Further, a problem also arises that a press force controller must be installed just above a molten zinc plating bath. The technology has the disadvantage that the press force controller needs to be exposed to a very bad environment and the adjustment, maintenance and inspection of the press force becomes difficult because the above-mentioned gas wiping nozzle for adjusting the amount of plated molten zinc deposited on a steel strip, and the like are disposed in the vicinity of the press force controller and the molten metal plated on the steel strip is partly scattered by the gas used for the wiping nozzle.

SUMMARY OF THE INVENTION

In view of the above-described circumstances, it is an object of this invention to provide an apparatus for removing substances deposited on a roll in a molten metal plating bath. The apparatus is installed in a molten metal plating line. The apparatus can provide a simple structure, is less expensive, fails less often, and is excellent in maintainability. This invention also provides a method for preventing the occurrence of dents on a molten-metal-plated steel strip.

According to a first aspect of this invention, the apparatus includes a blade disposed to be pressed against a roll dipped in a molten metal plating bath, in which a metal strip travels. The blade scrapes away substances deposited on the surface of the roll. The apparatus also includes an arm for supporting the blade, and a screw member disposed above the plating bath, so as to traverse it and movable along the axis of the roll in the bath for removing substances deposited on the roll in the molten metal plating bath. Floats are mounted on the arm for adjusting the press force of the blade applied to the roll in the bath.

It is preferable that weights be mounted on the arm for adjusting the press force of the blade applied to the roll in the molten metal plating bath.

It is preferable that the width of the blade be from about one-tenth to about one-fourth of the barrel length of the roll.

It is preferable that the roll in the molten metal plating bath be a sink roll.

It is preferable that the molten metal is zinc containing aluminum and the metal strip is a steel strip.

According to a second aspect of this invention, there is provided a method for preventing the occurrence of dents on a molten-metal-plated metal strip when the metal strip travels and is continuously dipped into a molten metal plating bath and then pulled upward from the bath so that molten metal is plated on the surface of the metal strip. The method includes mounting the apparatus of the first aspect of the invention for removing substances deposited on the surface of a roll in the molten metal plating bath, and plating the metal strip by removing the substances deposited on the surface of the roll in the molten metal plating bath.

According to this invention, substances deposited on the surface of the roll (a support roll for preventing the vibration of the metal strip in addition to the sink roll) in the molten metal plating bath can be stably removed without problems, while a plating operation is carried out. As a result, dents conventionally produced on the metal strip having been plated can be reduced. Further, the effect that equipment cost is less expensive can be obtained because the apparatus is not complex in structure as compared with the structure of a conventional apparatus.

Figure 1:
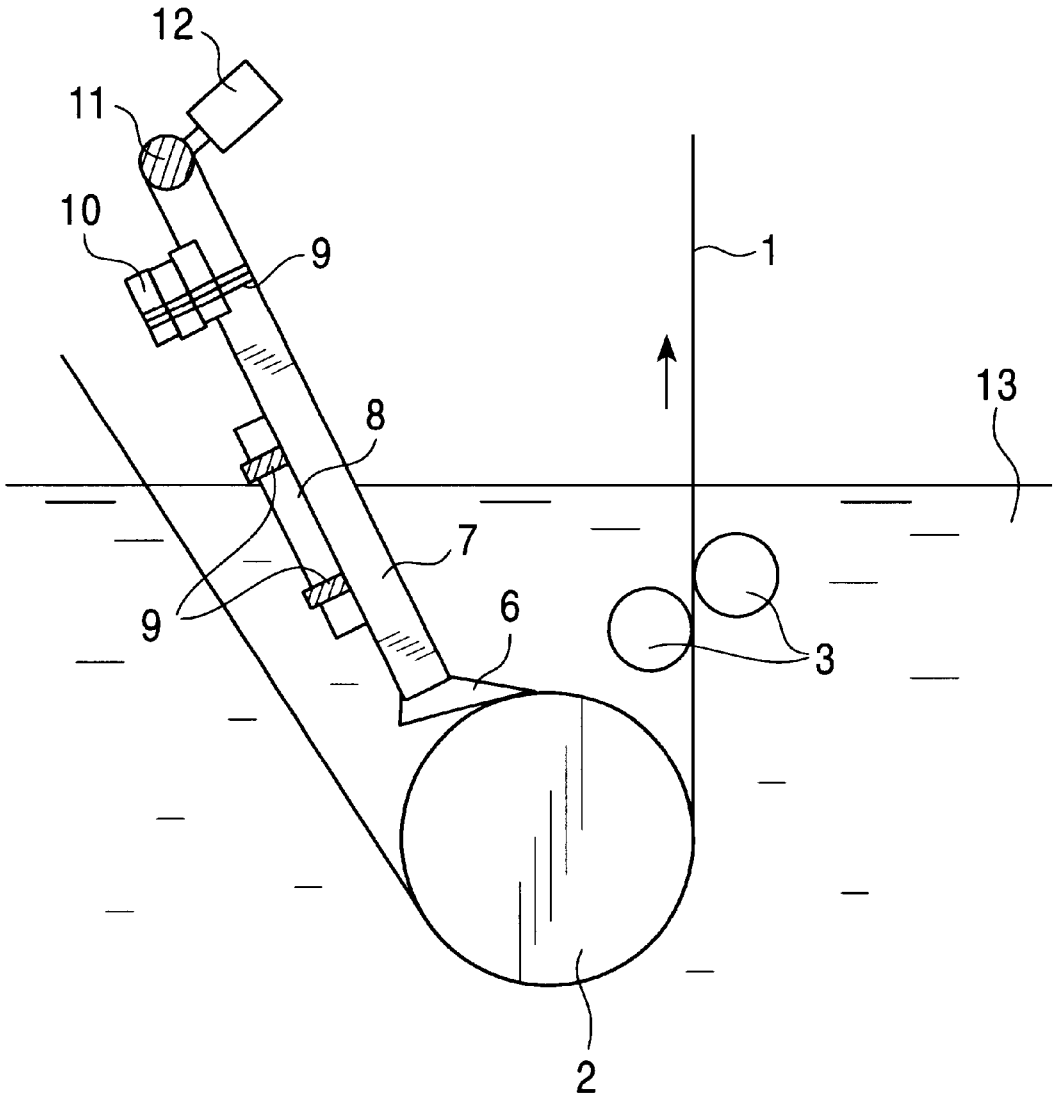
FIG. 1 is a longitudinal sectional view schematically showing an apparatus for removing substances deposited on a roll in a molten metal plating bath according to this invention.

In the figures, reference numeral 1 denotes a metal strip (steel strip), reference numeral 2 denotes a roll in a bath (sink roll), reference numeral 3 denotes support rolls, reference numeral 4 denotes gas wiping nozzles, reference numeral 5 denotes touch rolls, reference numeral 6 denotes a blade, reference numeral 7 denotes an arm, reference numeral 8 denotes a float, reference numeral 9 denotes a seat, reference numeral 10 denotes a weight, reference numeral 11 denotes a screw member, reference numeral 12 denotes a motor, and reference numeral 13 denotes a molten metal plating bath (plating bath).

DETAILED DESCRIPTION OF PREFERRED EMBODIMENTS

Embodiments of this invention will be described below.

Figure 3:
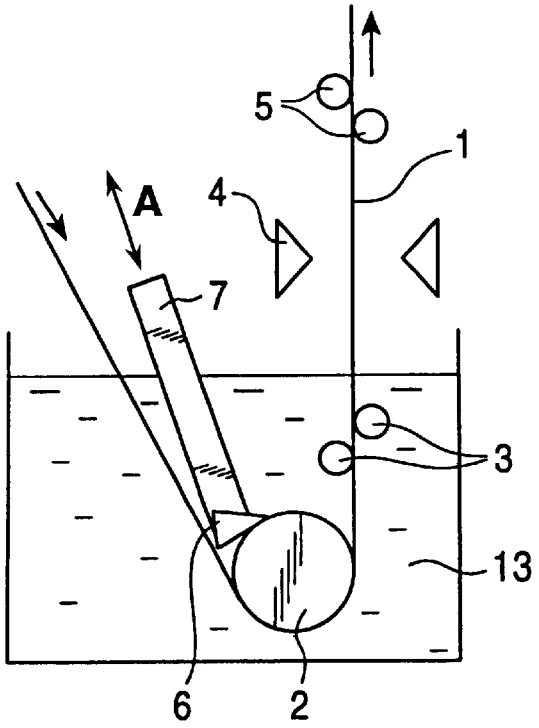
FIG. 3 is a longitudinal sectional view schematically showing a conventional molten metal plating bath.

First, how a plating bath and deposited substances removing device are disposed will be described with reference to FIG. 3.

A traveling direction of a steel strip 1 continuously dipped into a plating bath 13 in an inclined state is changed to a vertical direction by a sink roll 2 dipped in a molten metal plating bath 13 so that the steel strip 1 is pulled upward. Thereafter, the steel strip 1 passes between a pair of upper and lower rolls that are separately disposed to clamp the front and back surfaces of the steel strip 1 so as to prevent the vibration of the steel strip 1 in the plating bath 13, and then is pulled up from the plating bath 13 through a pair of upper and lower support rolls 3. Wiping nozzles 4, which blow gases to both surfaces of the steel strip 1, are disposed above the plating bath 13 so that an amount of molten metal deposited on the surfaces of the steel strip 1 is adjusted to an appropriate amount by the gases blown to the steel strip 1. Subsequently, the steel strip 1 passes between touch rolls 5 disposed above the wiping nozzles 4 and supplied to a cooler (not shown) disposed downstream.

In the above-described situation, substances deposited on the surface of the sink roll 2 disposed in the plating bath 13 are removed while a plating operation is performed. For this purpose, a blade 6, which comes into contact with the surface of the sink roll 2 and scrapes away the deposited substances, is mounted on an arm 7 as shown in FIG. 3, such that the blade 6 is pressed against the surface of the sink roll 2 by the forward and backward movement of the arm 7 in the axial direction A of the arm 7.

Known blades 6 include a blade having a width covering the entire length of the roll 2 in the axial direction of the roll, and a blade having a width smaller than that of the roll 2 and moved in the axial direction of the roll 2. However, these blades have the disadvantages described above, respectively.

The inventors paid attention to the deposited substances removing apparatus with a system for moving a narrow blade 6 which is disclosed in Japanese Unexamined Patent Application Publication No. 61-133369 and made diligent efforts to overcome the drawbacks of the apparatus; namely, that (1) the apparatus is complex in structure (which means that the apparatus is also expensive), and (2) the maintenance and inspection of the apparatus are difficult.

First, when the blade 6, which is brought into contact with the surface of a sink roll 2, has a large press force, it can be expected that its ability for removing substances deposited on the sink roll 2 is increased. However, the blade 6 is very promptly worn and must be replaced often. What is particularly important is that when an extreme end of the blade is worn, the pressure of the contact surface of the blade tends to decrease, which lowers the deposited substances removing effect of the blade. Further, when the extreme end of the blade is unevenly worn, the surface of the sink roll 2 itself is damaged. The blade 6 disclosed in Japanese Unexamined Patent Application Publication No. 61-133369 employs a device for mechanically moving a blade forward and backward to control a press force. For that reason, it is contemplated that the press force must be adjusted by a torque sensor because the press force is excessively large. As a result, the apparatus is made complex and expensive.

Figure 2:
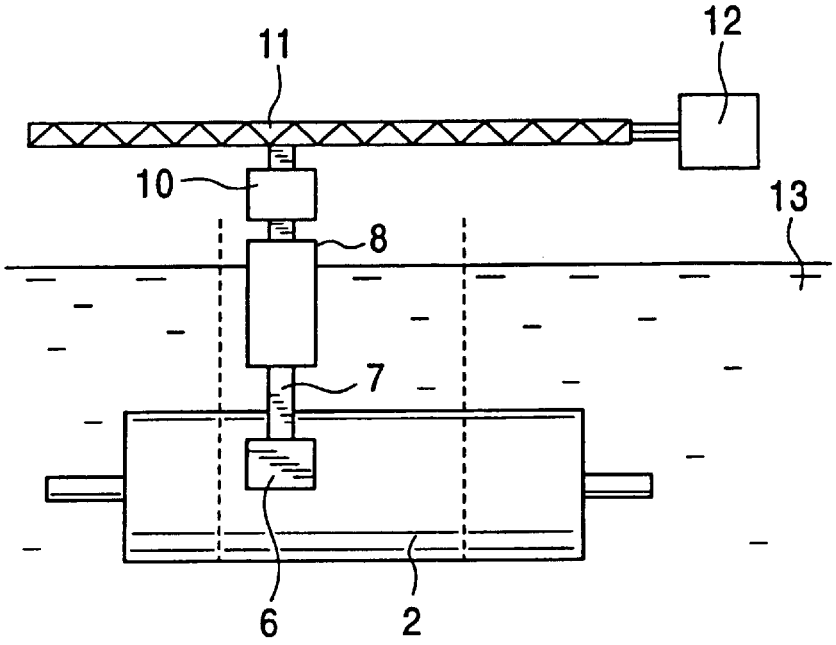
FIG. 2 is a front elevational view of the apparatus shown in FIG. 1.

To cope with the above problem, the inventors improved the structure of the deposited substances removing apparatus to the following simple structure by confirming that the press force could be adequately set to a relatively small value by conducting extensive experiments and studies as to the press force of the blade 6. The inventors discovered that only the self weight of the arm 7 for supporting the blade 6 was sufficiently heavy and that an optimum value of the press force is exceeded only by the weight of the arm 7. As a countermeasure, a float 8 was attached to the arm 7 supporting the blade 6 to reduce the self weight of the arm 7 as shown in FIGS. 1 and 2. The reason that when the float 8 is entirely or partly dipped into the plating bath 13, a buoyant force is associated with the float 8 and the weight of the arm 7 can be reduced by the buoyant force. Mount seats 9 are disposed to the arm 7 and a plurality of floats 8 are mounted on the seats 9 so as to be optionally locked thereto and removed therefrom individually. Accordingly, an increase in the number of the floats 8 can reduce the press force of the blade 6, and the number of the floats 8 is arranged such that when their number is maximized, the blade 6 is not in contact with the surface of the roll. It is preferable that the floats 8 be a hollow box made of a material that can withstand molten zinc. For example, the floats 8 can be formed of stainless steels, such as SUS316L or the like, or a block of suitable ceramics having a specific gravity smaller than that of the molten zinc. Further, it is also possible to change the press force of the blade 6 against the surface of the roll by sliding the float in the direction of the arm.

Incidentally, there is a case in which an approximate press force cannot be applied only by changing the number of the floats 8. The reason is that because various types of plating baths, plating baths having various heights, various types of steel strips, steel strips having various sizes and various traveling speeds are employed in an actual operation, it is predicted that there is a case in which the float 8 having a given size and composed of a given material cannot cope. Accordingly, in this invention, a seat 9 on which a weight 10 is mounted is disposed above the seats 9 having the floats 8 of the arm 7 mounted thereon as shown in FIGS. 1 and 2. That is, a plurality of the weights 10 are mounted on the seat 9 so as to be locked thereto and removed therefrom optionally similarly to the floats 8 so that the force exerted on the blade 6 can be finely adjusted by changing the number of the weights 10. It is preferable that the weight 10 be composed of lead, iron, or the like.

According to the apparatus according to this invention having the blade 6 and the arm 7 constructed as described above, a worker can optionally adjust the press force at any time while operation is being executed by observing the state of the surface of the plated steel strip 1. Therefore, the above problem (1) of known apparatus that the apparatus is complex and expensive can be solved at once. Further, because the apparatus is simply constructed, the maintenance and inspection of the apparatus can be easily performed in a short time even in a bad working environment, by which the above problem (2) of known apparatus can be simultaneously solved.

The inventors examined the width of the blade 6, which was not almost examined conventionally as a step of the development of an optimum deposited substances removing apparatus.

Figure 4:
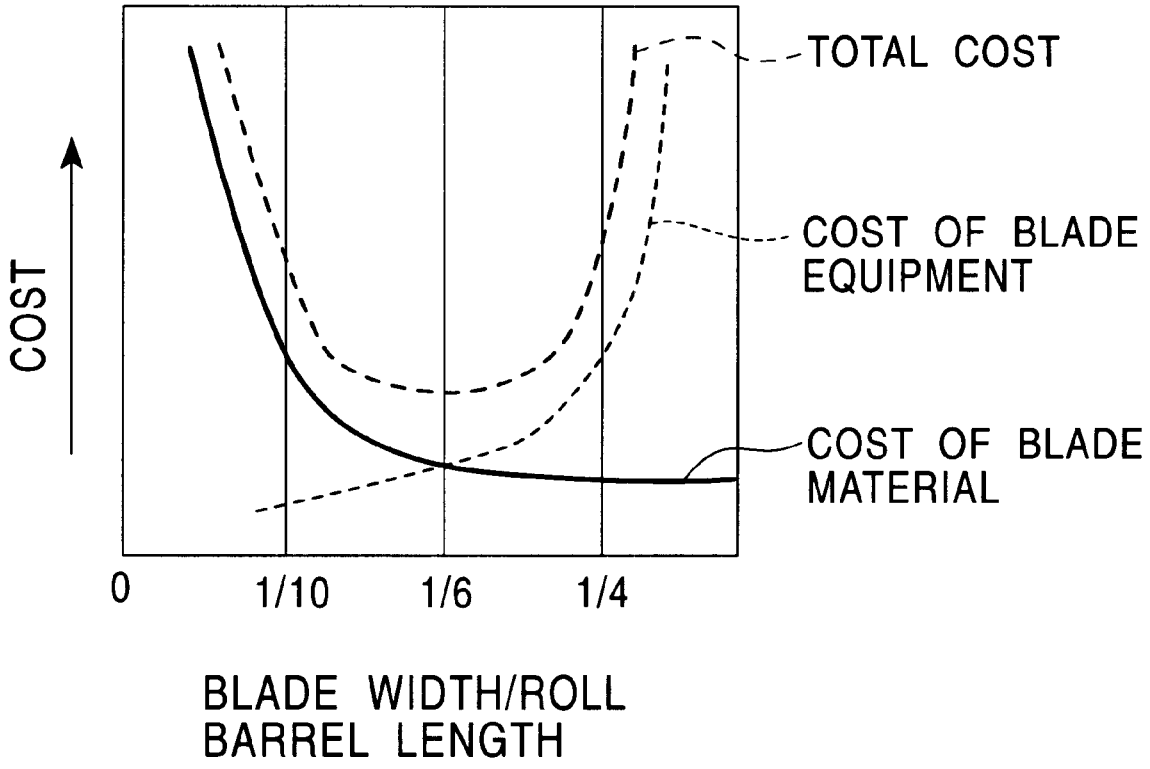
FIG. 4 is a graph showing the relationship between the blade width and the cost of an extreme end material and the cost of a deposited material removing apparatus.

As a result, the inventors determined that when the width of the blade is too short, the wearing speed of an extreme end of the blade is increased as apparent from FIG. 4, which increases the cost of the blade 6 because the blade 6 must be replaced more frequently. Inversely, when the width of the blade is too long, the size of the apparatus itself is increased, which increases equipment cost. Thus, the inventors have confined that the width of the blade is preferably within the range of about one-tenth to about one-fourth of the barrel length of a roll as a result of various experiments executed based on this study. Specifically, when the sink roll 2 has a barrel length of about 2200 , the width of the blade 6 is about 220 mm to about 550 mm.

Thus, the utilization of the apparatus according to this invention for removing substances deposited on a roll in a plating bath permits the substances deposited on the roll in the plating bath to be smoothly and reliably removed. Accordingly, dents conventionally formed on the surface of a product can be reduced in the manufacture of a molten-metal-plated steel strip. Thus, the inventors have added a method for preventing dents from being formed on a product from the above substances deposited on the product by using the above operational procedures according to this invention.

EXAMPLE

The deposited substances removing apparatus according to this invention shown in FIGS. 1 and 2 for removing substances deposited on a roll in a molten metal plating bath was disposed to a molten zinc plating bath for the steel strip 1, and a plating operation was actually executed.

The steel strip 1 was obtained by cold rolling a continuously cast billet of very low carbon steel and the size of the steel strip 1 was changed in the plating operation. The traveling speed of the steel strip 1 was set to a constant value of 100 m/min, the temperature of the molten zinc plating bath was set to 420° C., and the temperature of the steel strip was set to 450° C. when it was dipped into the plating bath.

Floats 8 each having a size of 100 mm×150 mm and composed of stainless steel SUS316L were mounted on the arm 7 of the apparatus in the range of the number of one to ten pieces so that the number of the floats 8 could be optionally changed. Further, the weights 10 each having a size of 100 mm×100 mm and composed of iron were mounted on the arm 7 in the range of one to ten pieces so that they could be optionally locked to and removed from the arm 7. Furthermore, the blade 6 had a width of 350 mm, a thickness of 30 mm and was composed of stainless steel SUS316L. As shown in FIG. 2, the blade 6 and the arm 7 were supported by a screw member 11, which traversed above the plating bath 13, as well as the screw member 11 was driven by a motor 12 so as to move along the axis of the sink roll 2.

Figure 5:
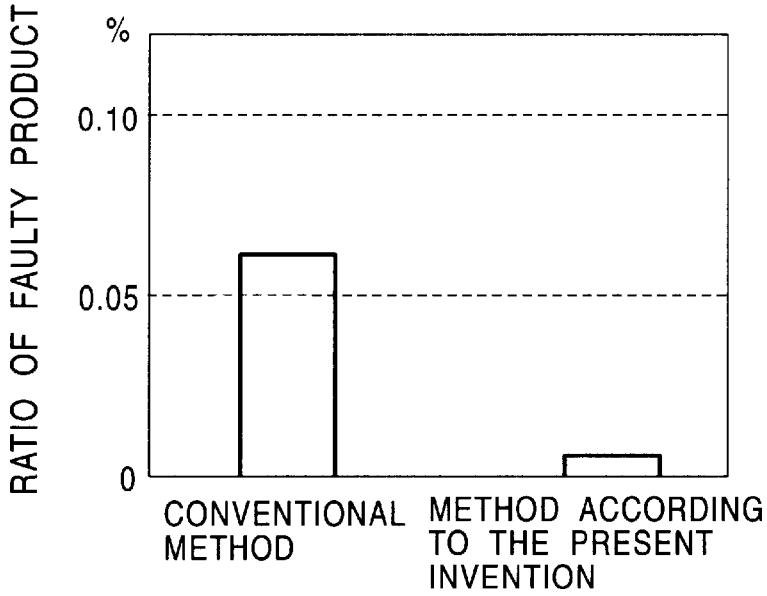
FIG. 5 is a graph showing an effect obtained by embodying this invention in terms of a ratio of faulty products.
Figure 6:
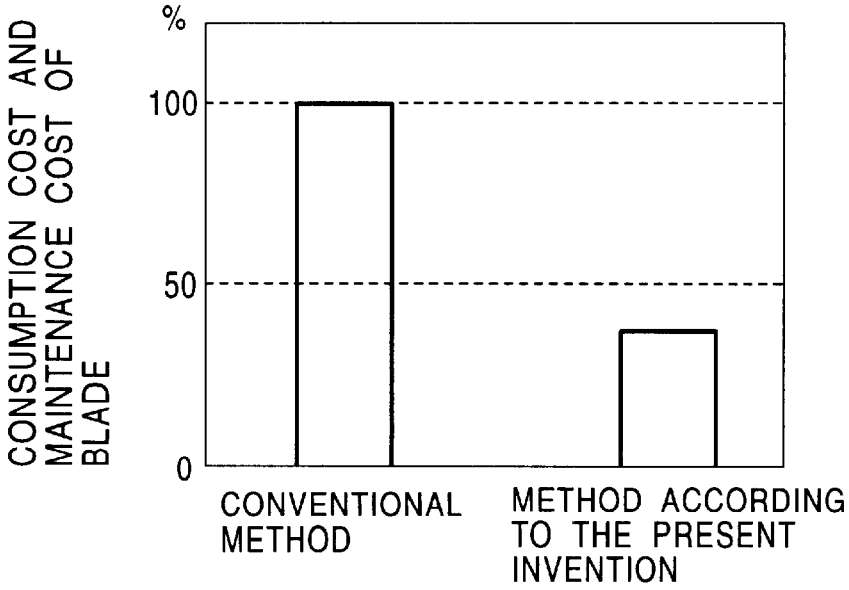
FIG. 6 is a graph showing the result of improvement of blade consumption cost and blade maintenance cost.

A result of a plating operation carried out while changing the number of the mounted floats 8 and/or the mounted weights 10 based on the state of the surface of the plated steel strip 1 observed by a worker, was evaluated by the faulty ratio of molten-zinc-plated steel strips obtained by the above plating operation (weight of the faulty portion of the products/weight of all the products). FIG. 5 shows the result of the evaluation. It is apparent from FIG. 5 that the use of the apparatus according to this invention permitted a molten-zinc-plated steel strip that was excellent in quality to be more stably manufactured as compared with a conventional method. Further, the need of replacing the blade in the plating operation could be greatly reduced as compared with the conventional method and the cost of maintenance and service and the cost of the blade could be greatly reduced as shown in FIG. 6.

In the above-described Example, the metal strip that was plated was steel strip and the molten metal plating was a molten zinc plating. However, this invention is not limited to only such materials and it can be applied to any metal strip composition and to any molten metal plating composition.

As described above, substances deposited on the surface of the roll in the molten metal plating bath can be stably removed by this invention without any problems in a plating operation. As a result, the occurrence of dents in metal strips having been plated can be reduced. Further, the apparatus of this invention provides the advantage of reducing equipment cost because the apparatus is not complex in structure as compared with the structure of a conventional apparatus.

What is claimed is:

1. An apparatus for removing substances deposited on a surface of a roll in a molten metal plating bath in which a metal strip travels, the apparatus comprising:

a blade disposed to be pressed against the roll dipped in the molten metal plating bath, the blade removes substances deposited on a surface of the roll;

an arm supporting the blade; and a screw member disposed above the plating bath so as to traverse the plating bath and making the arm movable along an axis of the roll in the bath for removing substances deposited on the roll in the molten metal plating bath, the screw member including floats mounted on the arm for adjusting a press force of the blade applied to the roll in the molten metal plating bath.

2. The apparatus according to claim 1, further comprising weights mounted on the arm for adjusting the press force of the blade applied to the roll in the molten metal plating bath.

3. The apparatus according to claim 1, wherein the blade has a width equal to about one-tenth to about one-fourth of a barrel length of the roll.

4. The apparatus according to claim 2, wherein the blade has a width equal to about one-tenth to about one-fourth of a barrel length of the roll.

5. The apparatus according to claim 1, further comprising a roll in the molten metal plating bath wherein the roll is a sink roll.

6. The apparatus according to claim 2, further comprising a roll in the molten metal plating bath wherein the roll is a sink roll.

7. The apparatus according to claim 3, further comprising a roll in the molten metal plating bath wherein the roll is a sink roll.

8. The apparatus according to claim 4, further comprising a roll in the molten metal plating bath wherein the roll is a sink roll.

9. The apparatus according to claim 1, further comprising:

a molten metal plating bath containing a molten metal; and a metal strip arranged to move in the plating bath, wherein the molten metal is zinc containing aluminum and the metal strip is a steel strip.

10. The apparatus according to claim 2, further comprising:

a molten metal plating bath containing a molten metal; and a metal strip arranged to move in the plating bath containing a molten metal, wherein the molten metal is zinc containing aluminum and the metal strip is a steel strip.

11. The apparatus according to claim 3, further comprising:

a molten metal plating bath containing a molten metal; and a metal strip arranged to move in the plating bath, wherein the molten metal is zinc containing aluminum and the metal strip is a steel strip.

12. The apparatus according to claim 4, further comprising:

a molten metal plating bath containing a molten metal; and a metal strip arranged to move in the plating bath, wherein the molten metal is zinc containing aluminum and the metal strip is a steel strip.

13. The apparatus according to claim 5, further comprising:

a molten metal plating bath containing a molten metal; and a metal strip arranged to move in the plating bath, wherein the molten metal is zinc containing aluminum and the metal strip is a steel strip.

14. The apparatus according to claim 6, further comprising:

a molten metal plating bath containing a molten metal; and a metal strip arranged to move in the plating bath, wherein the molten metal is zinc containing aluminum and the metal strip is a steel strip.

15. The apparatus according to claim 7, further comprising:

a molten metal plating bath containing a molten metal; and a metal strip arranged to move in the plating bath, wherein the molten metal is zinc containing aluminum and the metal strip is a steel strip.

16. The apparatus according to claim 8, further comprising:

a molten metal plating bath and a metal strip arranged to move in the plating bath, wherein the molten metal is zinc containing aluminum and the metal strip is a steel strip.

17. A method for preventing the occurrence of dents on a molten-metal-plated metal strip when the metal strip travels and is continuously dipped into a molten metal plating bath and then pulled upward from the molten metal plating bath so that molten metal is plated on the surface of the metal strip, the method comprising:

mounting an apparatus according to claim 1 for removing substances deposited on the surface of a roll in the molten metal plating bath; and plating the metal strip by removing the substances deposited on the surface of the roll in the molten metal plating bath with the apparatus.

18. A method for preventing the occurrence of dents on a molten-metal-plated metal strip when the metal strip travels and is continuously dipped into a molten metal plating bath and then pulled upward from the molten metal plating bath so that molten metal is plated on the surface of the metal strip, the method comprising:

mounting an apparatus according to claim 2 for removing substances deposited on the surface of a roll in the molten metal plating bath; and plating the metal strip by removing the substances deposited on the surface of the roll in the molten metal plating bath with the apparatus.

19. A method for preventing the occurrence of dents on a molten-metal-plated metal strip when the metal strip travels and is continuously dipped into a molten metal plating bath and then pulled upward from the molten metal plating bath so that molten metal is plated on the surface of the metal strip, the method comprising:

mounting an apparatus according to claim 3 for removing substances deposited on the surface of a roll in the molten metal plating bath; and plating the metal strip by removing the substances deposited on the surface of the roll in the molten metal plating bath with the apparatus.

20. A method for preventing the occurrence of dents on a molten-metal-plated metal strip when the metal strip travels and is continuously dipped into a molten metal plating bath and then pulled upward from the molten metal plating bath so that molten metal is plated on the surface of the metal strip, the method comprising:

mounting an apparatus according to claim 4 for removing substances deposited on the surface of a roll in the molten metal plating bath; and plating the metal strip by removing the substances deposited on the surface of the roll in the molten metal plating bath with the apparatus.

21. A method for preventing the occurrence of dents on a molten-metal-plated metal strip when the metal strip travels and is continuously dipped into a molten metal plating bath and then pulled upward from the molten metal plating bath so that molten metal is plated on the surface of the metal strip, the method comprising:

mounting an apparatus according to claim 5 for removing substances deposited on the surface of a roll in the molten metal plating bath; and plating the metal strip by removing the substances deposited on the surface of the roll in the molten metal plating bath with the apparatus.

22. A method for preventing the occurrence of dents on a molten-metal-plated metal strip when the metal strip travels and is continuously dipped into a molten metal plating bath and then pulled upward from the molten metal plating bath so that molten metal is plated on the surface of the metal strip, the method comprising:

mounting an apparatus according to claim 6 for removing substances deposited on the surface of a roll in the molten metal plating bath; and plating the metal strip by removing the substances deposited on the surface of the roll in the molten metal plating bath with the apparatus.

23. A method for preventing the occurrence of dents on a molten-metal-plated metal strip when the metal strip travels and is continuously dipped into a molten metal plating bath and then pulled upward from the molten metal plating bath so that molten metal is plated on the surface of the metal strip, the method comprising:

mounting an apparatus according to claim 7 for removing substances deposited on the surface of a roll in the molten metal plating bath; and plating the metal strip by removing the substances deposited on the surface of the roll in the molten metal plating bath with the apparatus.

24. A method for preventing the occurrence of dents on a molten-metal-plated metal strip when the metal strip travels and is continuously dipped into a molten metal plating bath and then pulled upward from the molten metal plating bath so that molten metal is plated on the surface of the metal strip, the method comprising:

mounting an apparatus according to claim 8 for removing substances deposited on the surface of a roll in the molten metal plating bath; and plating the metal strip by removing the substances deposited on the surface of the roll in the molten metal plating bath with the apparatus.

25. A method for preventing the occurrence of dents on a molten-metal-plated metal strip when the metal strip travels and is continuously dipped into a molten metal plating bath and then pulled upward from the molten metal plating bath so that molten metal is plated on the surface of the metal strip, the method comprising:

mounting an apparatus according to claim 9 for removing substances deposited on the surface of a roll in the molten metal plating bath; and plating the metal strip by removing the substances deposited on the surface of the roll in the molten metal plating bath with the apparatus.

26. A method for preventing the occurrence of dents on a molten-metal-plated metal strip when the metal strip travels and is continuously dipped into a molten metal plating bath and then pulled upward from the molten metal plating bath so that molten metal is plated on the surface of the metal strip, the method comprising:

mounting an apparatus according to claim 10 for removing substances deposited on the surface of a roll in the molten metal plating bath; and plating the metal strip by removing the substances deposited on the surface of the roll in the molten metal plating bath with the apparatus.

27. A method for preventing the occurrence of dents on a molten-metal-plated metal strip when the metal strip travels and is continuously dipped into a molten metal plating bath and then pulled upward from the molten metal plating bath so that molten metal is plated on the surface of the metal strip, the method comprising:

mounting an apparatus according to claim 11 for removing substances deposited on the surface of a roll in the molten metal plating bath; and plating the metal strip by removing the substances deposited on the surface of the roll in the molten metal plating bath with the apparatus.

28. A method for preventing the occurrence of dents on a molten-metal-plated metal strip when the metal strip travels and is continuously dipped into a molten metal plating bath and then pulled upward from the molten metal plating bath so that molten metal is plated on the surface of the metal strip, the method comprising:

mounting an apparatus according to claim 12 for removing substances deposited on the surface of a roll in the molten metal plating bath; and plating the metal strip by removing the substances deposited on the surface of the roll in the molten metal plating bath with the apparatus.

29. A method for preventing the occurrence of dents on a molten-metal-plated metal strip when the metal strip travels and is continuously dipped into a molten metal plating bath and then pulled upward from the molten metal plating bath so that molten metal is plated on the surface of the metal strip, the method comprising:

mounting an apparatus according to claim 13 for removing substances deposited on the surface of a roll in the molten metal plating bath; and plating the metal strip by removing the substances deposited on the surface of the roll in the molten metal plating bath with the apparatus.

30. A method for preventing the occurrence of dents on a molten-metal-plated metal strip when the metal strip travels and is continuously dipped into a molten metal plating bath and then pulled upward from the molten metal plating bath so that molten metal is plated on the surface of the metal strip, the method comprising:

mounting an apparatus according to claim 14 for removing substances deposited on the surface of a roll in the molten metal plating bath; and plating the metal strip by removing the substances deposited on the surface of the roll in the molten metal plating bath with the apparatus.

31. A method for preventing the occurrence of dents on a molten-metal-plated metal strip when the metal strip travels and is continuously dipped into a molten metal plating bath and then pulled upward from the molten metal plating bath so that molten metal is plated on the surface of the metal strip, the method comprising:

mounting an apparatus according to claim 15 for removing substances deposited on the surface of a roll in the molten metal plating bath; and plating the metal strip by removing the substances deposited on the surface of the roll in the molten metal plating bath with the apparatus.

32. A method for preventing the occurrence of dents on a molten-metal-plated metal strip when the metal strip travels and is continuously dipped into a molten metal plating bath and then pulled upward from the molten metal plating bath so that molten metal is plated on the surface of the metal strip, the method comprising:

mounting an apparatus according to claim 16 for removing substances deposited on the surface of a roll in the molten metal plating bath; and plating the metal strip by removing the substances deposited on the surface of the roll in the molten metal plating bath with the apparatus.

* * * * *